US011564446B1

(12) United States Patent
Robusti et al.

(10) Patent No.: US 11,564,446 B1
(45) Date of Patent: Jan. 31, 2023

(54) OUTSOLES HAVING TRACTION INSERTS

(71) Applicant: Lululemon Athletica Canada Inc., Vancouver (CA)

(72) Inventors: George Alan Robusti, Portland, OR (US); Grant F. Kovach, Portland, OR (US); Christopher Ka-Yin Lam, Portland, OR (US); Mark Arthur Oleson, Portland, OR (US); Heather Patricia Pieraldi, Portland, OR (US)

(73) Assignee: Lululemon Athletica Canada Inc., Vancouver (CA)

( * ) Notice: Subject to any disclaimer, the term of this patent is extended or adjusted under 35 U.S.C. 154(b) by 0 days.

(21) Appl. No.: 17/381,101

(22) Filed: Jul. 20, 2021

(51) Int. Cl.

| | |
|---|---|
| ***A43B 1/10*** | (2006.01) |
| ***A43B 13/12*** | (2006.01) |
| ***A43B 13/26*** | (2006.01) |
| ***A43B 13/04*** | (2006.01) |
| ***A43B 13/22*** | (2006.01) |

(52) U.S. Cl.
CPC ..... *A43B 13/26* (2013.01); *A43B 13/04* (2013.01); *A43B 13/122* (2013.01); *A43B 13/223* (2013.01)

(58) Field of Classification Search
CPC ..... A43B 13/02; A43B 13/223; A43B 13/188
See application file for complete search history.

(56) References Cited

U.S. PATENT DOCUMENTS 2,316,601 A * 4/1943 Larkin ..... A43B 13/26 36/59 A
4,747,220 A * 5/1988 Autry ..... A43B 13/26 36/114
4,845,863 A * 7/1989 Yung-Mao ..... A43B 1/0072 36/114
4,897,936 A * 2/1990 Fuerst ..... A43B 13/223 36/31
5,775,005 A * 7/1998 McClelland ..... A43B 1/0072 36/134
6,016,613 A * 1/2000 Campbell ..... A43B 5/001 D2/906
6,161,315 A * 12/2000 Dalton ..... A43B 5/001 36/134
6,915,596 B2 * 7/2005 Grove ..... A43B 3/246 36/15
7,370,439 B1 * 5/2008 Myers ..... A43B 13/26 36/31
7,895,773 B2 * 3/2011 Robinson, Jr. ..... A43B 13/189 36/153
7,905,034 B2 * 3/2011 Robinson, Jr. ..... A43B 13/26 36/134
9,351,534 B2 * 5/2016 Peikert ..... A43B 7/125
(Continued)

FOREIGN PATENT DOCUMENTS

| | | | |
|---|---|---|---|
| EP | 1073350 | A1 | 2/2001 |
| KR | 20090060970 | A | 6/2009 |
| WO | 2020040513 | A1 | 2/2020 |

*Primary Examiner* — Jila M Mohandesi
(74) *Attorney, Agent, or Firm* — Kolitch Romano Dascenzo Gates LLC

(57) ABSTRACT

An article of footwear may include an outsole having an opening extending from a top face of the outsole to a ground-contacting face of the outsole, and a traction member disposed within the opening in the outsole. The traction member has a protruding portion and flange portion extending from an upper end of the protruding portion. The flange portion is secured to the top face of the outsole.

18 Claims, 5 Drawing Sheets

(56) References Cited

U.S. PATENT DOCUMENTS

| | | | | |
|---|---|---|---|---|
| 9,883,715 | B2 * | 2/2018 | McDonald | A43B 3/24 |
| 9,961,959 | B2 * | 5/2018 | Gerber | A43B 5/00 |
| 2009/0126230 | A1 * | 5/2009 | McDonald | A43B 13/12 36/88 |
| 2011/0192056 | A1 * | 8/2011 | Geser | A43B 13/26 36/114 |
| 2015/0305447 | A1 * | 10/2015 | Cavaliere | A43B 5/02 36/66 |
| 2016/0000185 | A1 | 1/2016 | Cook et al. | |
| 2016/0192739 | A1 * | 7/2016 | Hoffer | A43B 13/188 36/28 |
| 2016/0278484 | A1 * | 9/2016 | Aslani | A43C 15/02 |
| 2018/0317591 | A1 * | 11/2018 | Hollinger | A43B 7/1445 |
| 2021/0169174 | A1 | 6/2021 | Campos, II et al. | |

* cited by examiner

OUTSOLES HAVING TRACTION INSERTS

FIELD

This disclosure relates to systems and methods for footwear. More specifically, the disclosed embodiments relate to outsoles and related manufacturing methods.

INTRODUCTION

The sole of an article of footwear, such as an athletic shoe, typically provides support for a wearer's foot as well as traction between the article of footwear and underlying surfaces (e.g., the ground or a court surface). Wearing an article of footwear with a sole that provides a high level of traction may improve the performance and comfort of the footwear.

SUMMARY

The present disclosure provides systems, apparatuses, and methods relating to footwear outsoles.

In some embodiments, an article of footwear includes: an outsole having an opening extending from a top face of the outsole to a ground-contacting face of the outsole; and a traction member disposed within the opening in the outsole, the traction member comprising a protruding portion and flange portion extending from an upper end of the protruding portion and secured to the top face of the outsole.

In some embodiments, a method of manufacturing an article of footwear includes: forming a traction member comprising a flange portion and a protrusion; inserting the protrusion of the traction member into an opening in an outsole extending from a top face of the outsole to a ground-contacting face of the outsole; and securing the flange to the top face of the outsole.

Features, functions, and advantages may be achieved independently in various embodiments of the present disclosure, or may be combined in yet other embodiments, further details of which can be seen with reference to the following description and drawings.

DETAILED DESCRIPTION

Figure 1:
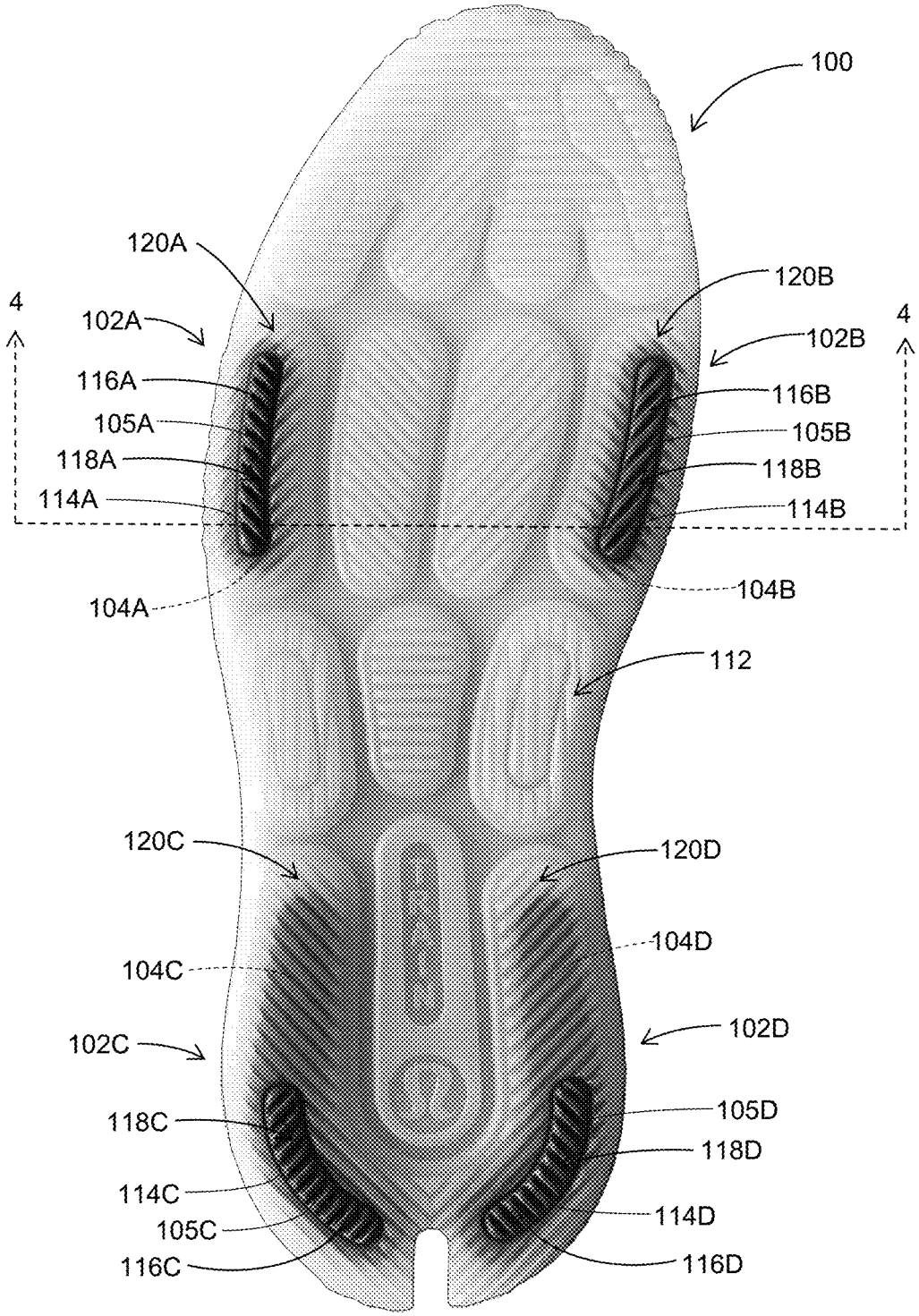
FIG. 1 is a bottom view of an illustrative outsole according to the present teachings.

Various aspects and examples of footwear outsoles having inserts adapted to provide traction, as well as related manufacturing methods, are described below and illustrated in the associated drawings. Unless otherwise specified, an outsole in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "medial," "lateral," "anterior," "posterior," and the like are intended to refer to anatomical directions corresponding to a human on whom the article or object is configured to be placed or worn. For example, "medial" refers to a relative position disposed toward the center of the human body, while "lateral" refers to a relative position disposed away from the center of the human body. With respect to footwear, the term "anterior" refers to a relative position closer to the toe of a wearer and "posterior" refers to a relative position closer to the heel of the wearer. In the absence of a wearer, the same directional terms may be used as if the article of footwear is being worn in its expected configuration.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

"EVA" refers to ethylene-vinyl acetate.

"TPU" refers to thermoplastic polyurethane.

"TPE" refers to thermoplastic elastomers.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, an article of footwear in accordance with the present teachings includes an outsole and one or more traction members incorporated into the outsole. The traction members (AKA inserts, traction inserts, or tread inserts) are configured to have one or more characteristics different than the outsole, such as hardness, color, material type, elasticity, rigidity, resilience, etc. In some examples, the inserts provide additional traction between the outsole and an underlying surface (e.g., the ground). Articles of footwear described herein may include shoes, boots, sandals, and/or any other suitable footwear or portion of footwear having an outsole.

The traction members each comprise a protrusion (AKA a ground-contacting element) having a peripheral flange extending from an upper end of the protrusion. The outsole has one or more corresponding openings, each extending therethrough (i.e., from a top face of the outsole to a bottom face of the outsole). Each of the traction members is disposed in a respective opening in the outsole. In some examples, a given traction member may have multiple protrusions corresponding to multiple openings. The flange of each traction member is secured or fastened to the top face of the outsole, for stability and security, while the protrusion extends to or beyond the ground-contacting bottom face of the outsole. In some examples, a bottom surface of the protrusion is configured to contact an underlying surface when used. The bottom surface of the protrusion is configured to provide traction between the outsole and the underlying surface. In some examples, the bottom surface of the protrusion has a tread pattern, and/or sipes.

In some examples, each of the openings in the outsole include a recess in the outsole at the top face of the outsole coupled with a hole (AKA aperture) extending to the bottom face of the outsole. In some examples, the recess has a different overall shape or planform than the hole or aperture. In some examples, the recess and the hole have a similar or identical planform. The traction member is disposed in the opening such that the flange is seated in the recess and the protrusion extends into and through the hole in the ground-contacting face of the outsole. In some examples, the flange of the traction member conforms to the recess of the outsole. In some examples, the recess is absent, such that the flange is configured to sit on the top surface of the outsole. In some examples, the aperture or hole through the outsole is surrounded laterally by the outsole.

In some examples, a bottom surface of the protrusion of the traction member is flush or generally coplanar with the ground-contacting face of the outsole. In some examples, the bottom surface of the protrusion extends beyond the ground-contacting face of the outsole. In some examples, the protrusion extends partway into the hole, such that the bottom surface of the protrusion is recessed with respect to the bottom face of the outsole. For example, the protrusion may be harder than the surrounding outsole, and may be configured to contact the underlying surface only after the outsole has been compressed.

The traction members may be disposed at any suitable positions with respect to the outsole. In some examples, two traction members are positioned in the anterior portion of the outsole, one on a medial side and one on a lateral side. In some examples, two traction members are positioned in the posterior portion of the outsole, one on a medial side and one on a lateral side. In some examples, two traction members positioned in the posterior or heel end of the outsole form a horseshoe shape. In some examples, traction members are disposed adjacent an outer edge of the outsole. In some examples, the protrusion and/or the flange of a traction member follows an adjacent outer contour of the outsole.

A method for manufacturing a sole for an article of footwear in accordance with the present teachings may include: forming one or more traction members, forming an outsole, and incorporating the one or more traction members into the outsole. This method advantageously allows for the generation of a variety of different soles having a variety of different characteristics.

In some examples, the traction members may be formed separately from the outsole, then inserted into and secured to the outsole. Forming the traction members may include compression molding, compression molding performed using heat, injection molding, dual injection molding, additive manufacturing (e.g., 3D printing), and/or any other suitable process(es). Forming the outsole may include any of the processes listed above for forming the traction members, and/or any other suitable process(es). In some examples, the traction members are secured to the outsole by adhesive. In some examples the traction members are secured to the outsole by compression molding, e.g., by compression molding the outsole and the traction members in a same mold, and/or using any other suitable process(es). The traction members are secured to the outsole such that the traction members are unable to move independently of the outsole.

In some examples, a layer of material is added on top of the outsole after the traction members have been inserted into the outsole. The layer of material covers the traction members such that the flange of the traction members is sandwiched between the top face of the outsole and the layer of material. The added layer may be compression molded or otherwise coupled to the outsole and traction members, such that the layer of material forms a top layer of the outsole, and may comprise a same material as the outsole. In some examples, a midsole is coupled to, and sits on top of the top layer of the outsole. In examples where the top layer is absent, the traction member may be sandwiched between the midsole and the top face of the outsole. For example, the flange of the traction member may be in direct contact with both the midsole and the outsole.

The traction members and/or the outsole may comprise TPU, TPE, blown rubber, high abrasion rubber, and/or any other suitable material. In some examples, the traction members comprise an elastomer. In some examples, the material comprising the traction members is the same as the material comprising the outsole. In some examples, the material comprising the traction members is harder, more malleable, and/or denser than the material comprising the outsole, or vice versa. In some examples the material comprising the traction members and the outsole have different colors, and/or translucencies. Forming the traction members and the outsole using materials with different colors, and/or translucencies may make the sole visually more appealing. In some examples, the outsole comprises a translucent material and the traction members (e.g., the flange and/or any other suitable portion of the inserts) comprise a non-translucent material having a color selected such that the flange of the traction members is visible through the outsole.

Many soles for footwear having different characteristics can be generated by following the manufacturing method of the present teachings. Changing the materials of the one or more traction members and the outsole can affect both the functionality and visual appearance of the sole. Changing the geometries of the one or more traction members, and the positioning of the one or more traction members within the outsole can also affect both the functionality and visual appearance of the sole. Advantageously, the manufacturing methods of the present disclosure allow transitioning between the manufacturing of soles having different characteristics with little or no change of equipment.

Examples, Components, and Alternatives

The following sections describe selected aspects of illustrative soles for footwear as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Outsole

Figure 2:
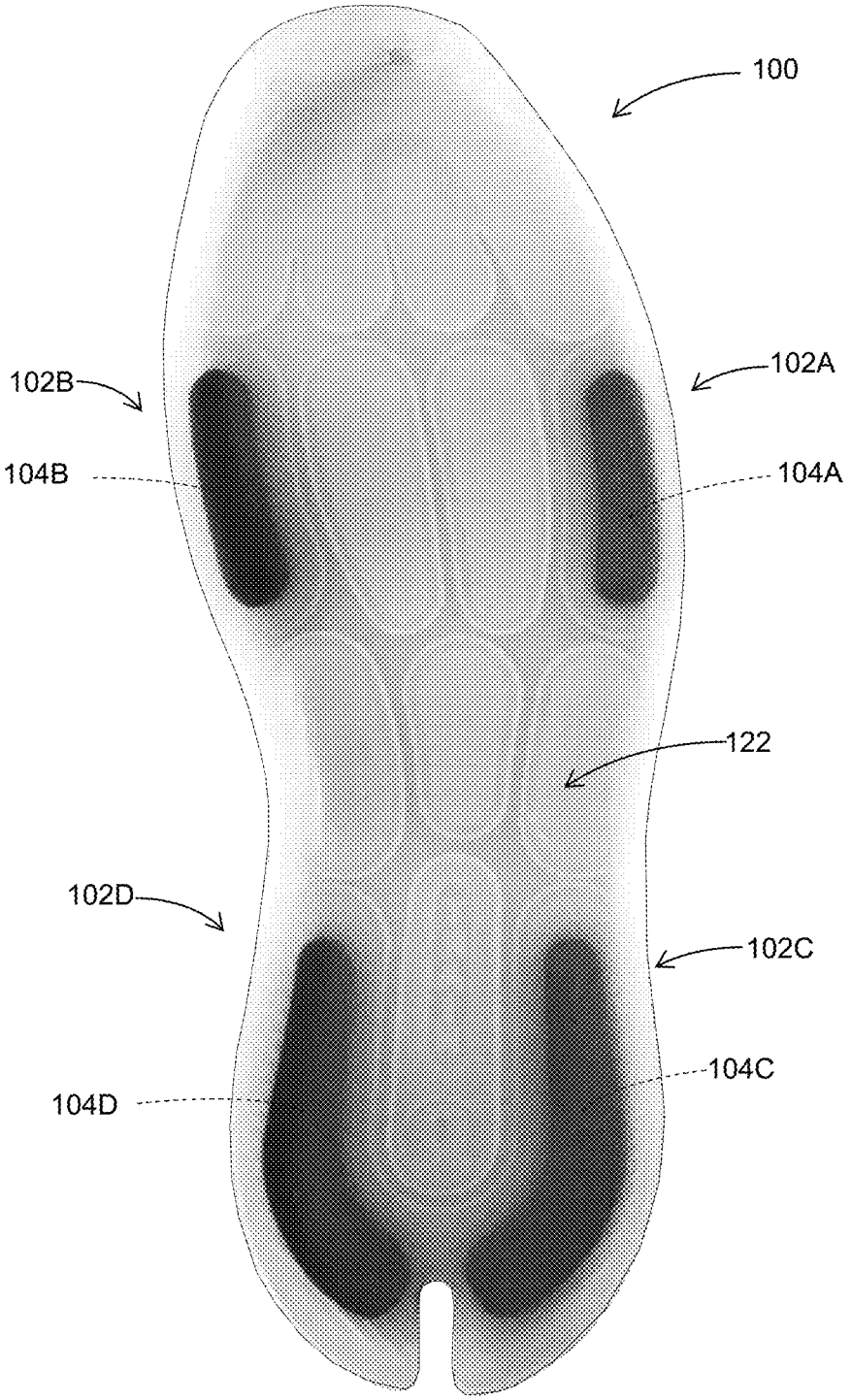
FIG. 2 is a top view of the outsole of FIG. 1.

FIGS. 1-2 depict an illustrative outsole for footwear including a plurality of traction members. The sole of FIGS. 1 and 2 is an example of the soles described in the Overview section above.

FIG. 1 is a bottom view of an outsole 100. Traction members 102A, 102B, 102C, and 102D, are incorporated into outsole 100. Traction member 102A is positioned in an anterior lateral region, traction member 102B is positioned in an anterior medial region, traction member 102C is positioned in a posterior lateral region, and traction member 102D is positioned in a posterior medial region of outsole 100. As discussed above, the traction members can be disposed at any other suitable positions and orientations with respect to the outsole, and any suitable number of traction members may be incorporated into the outsole.

Traction members 102A, 102B, 102C, and 102D each have a flange (104A, 104B, 104C, and 104D) and a protrusion (105A, 105B, 105C, and 105D). Each one of flanges 104A, 1048, 104C, and 104D are disposed in a respective recess in a top face of outsole 100. The flanges are secured to the top face of the outsole, for example using adhesive, compression molding the traction members and the outsole (e.g., in a same mold), and/or any other suitable process(es). In this example, outsole 100 comprises a translucent material (e.g., translucent rubber), and flanges 104A, 104B, 104C, 104D comprise a harder material having a solid color. Accordingly, the flanges are visible through a bottom or ground-contacting face 112 of the outsole. The outsole and the traction members may include any other suitable combination of colors and/or levels of translucency.

Protrusions 105A, 105B, 105C, and 105D extend into corresponding holes 114A, 114B, 114C, and 114D in outsole 100. Bottom surfaces of protrusions 116A, 116B, 116C, and 116D have tread patterns 118A, 118B, 118C, and 118D configured to provide traction with an underlying surface (e.g., the ground or an athletic track or court). Ground-contacting face 112 of the outsole also has tread patterns 120A, 120B, 120C, and 120D. In the example depicted in FIG. 1, the tread patterns of the traction inserts have a different orientation and/or pattern with respect to adjacent tread patterns of the outsole. For example, the tread pattern of one traction member may be diagonal in one direction, while the adjacent or surrounding tread pattern of the outsole is diagonal in the other direction. In some examples, the direction of the tread pattern of one traction member is parallel to the direction of the adjacent or surrounding tread pattern of the outsole. In general, the traction members and tread patterns may be configured to increase traction, prevent slipping, and/or enhance stability of the outsole. Any suitable pattern can be used, depending for example on the activity or expected type of ground contact surface. Tread patterns may be absent from the outsole, the traction members, or both. In some examples, the tread pattern is different than a tread pattern of a second traction member. In some examples, the tread pattern is different in different areas of the bottom surface. For example, the tread pattern may form an alternating pattern on the bottom surface and/or the tread pattern may change progressively across the bottom surface.

The flanges and protrusions of traction members may have any suitable shape and/or size configured to provide stability, traction, visual appeal, and/or manufacturability. As depicted in FIG. 1, each one of flanges 104A, 104B, 104C, and 104D has a larger planform than the corresponding protrusion. In some examples, the flange and the protrusion of a traction member have the same planform but different sizes. In some examples, the flange and the protrusion of the traction member have different planforms and different sizes. With respect to the corresponding protrusions, flanges 104C and 104D extend significantly farther toward the toe end of the outsole, and form a horseshoe shape in the posterior or heel end of outsole 100. The shape, and/or size of the flanges and the protrusions may affect both the functionality and appearance of the outsole. The flange of any given traction member may extend around a complete periphery of the protrusion, may extend only partially around the periphery (e.g., from only one side), and/or may be asymmetrical relative to the shape or position of the protrusion.

FIG. 2 is a top view of outsole 100. Traction members 102A, 102B, 102C, and 102D are incorporated into outsole 100. A top outsole layer 122 comprising the same translucent material as outsole 100 is disposed on top of the outsole and the traction members. Accordingly, flanges 104A, 104B, 104C, and 104D, are sandwiched between top outsole layer 122 and top face 110 of outsole 100. As mentioned above, top outsole layer 122 comprises the translucent rubber of outsole 100. Flanges 104A, 104B, 104C, and 104D are visible through the top outsole layer. In some examples, top layer 122 is opaque and/or a different material than outsole 100. Outsole 100 may be coupled to a midsole and/or an upper (e.g., as described below with respect to FIG. 3).

Figure 3:
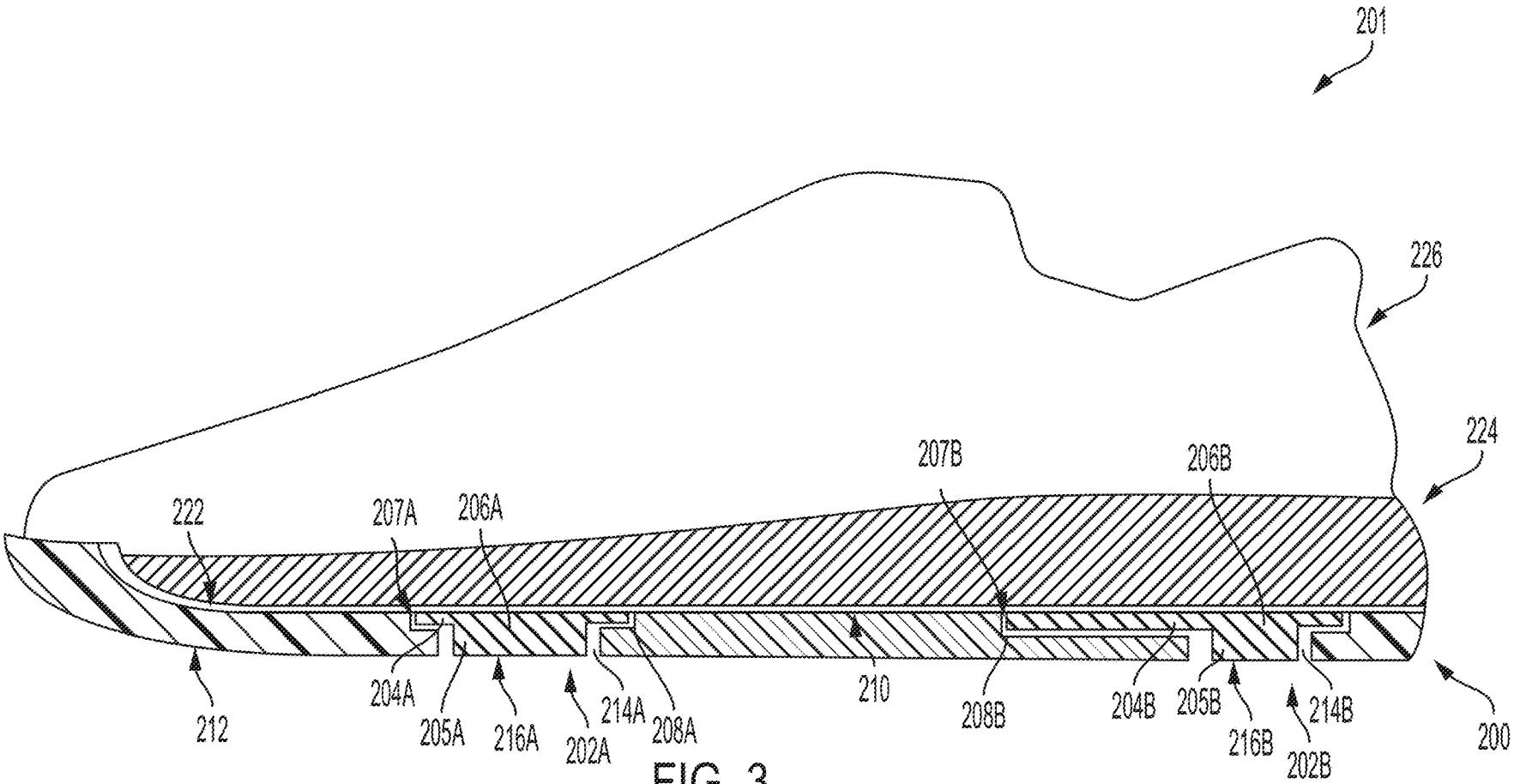
FIG. 3 is a schematic diagram depicting a cross section of an illustrative article of footwear having an outsole according to aspects of the present disclosure.

FIG. 3 is a schematic diagram of a cross section of another illustrative outsole 200 incorporated into an article of footwear 201 (i.e., a shoe). The cross section is taken along a posterior-to-anterior line with respect to article of footwear 201. Traction members 202A and 202B are depicted, with traction member 202A being disposed in an anterior region of the shoe and traction member 202B is disposed in a posterior region. Traction members 202A and 202B each comprise a protrusion (205A and 205B) and a flange (204A and 204B) extending from an upper end (206A and 206B) of the protrusion.

Flanges 204A and 204B have a horizontal dimension (e.g., width) greater than protrusions 205A and 205B, and a vertical dimension (e.g., thickness) less than protrusions 205A and 205B. In some examples, the horizontal, and/or vertical dimensions of the flanges and the protrusions are the same. In some examples, each traction member has the same shape, size, and/or planform as the other traction members. In some examples, each traction member has a different shape, size, and/or planform than one or more of the other traction members.

Outsole 200 comprises openings 207A and 207B extending through the outsole, from a top face 210 to a ground-contacting face 212 of outsole 200. Openings 207A and 207B each include a recess (208A and 208B) at a top face 210 of outsole 200 coupled with a hole (214A and 214B) extending to ground-contacting face 212 of outsole 200. In some examples, the openings do not include recesses.

Flanges 204A and 204B are seated in recesses 208A and 208B. Flanges 204A and 204B completely fill the recesses. In other words, each of the recesses is shaped and sized to conform to the corresponding flange. Flanges 204A and 204B are secured to recesses 208A and 208B such that the traction members are prevented from moving independently of the outsole. Protrusions 205A and 205B extend into and through holes 214A and 214B. A bottom surface (216A and 216B) of each of the protrusions is flush or generally coplanar with ground-contacting face 212. Bottom surfaces 216A and 216B of the protrusions are configured to provide traction with an underlying surface (e.g., the ground, or an athletic track or court). An optional top outsole layer 222 is disposed on top of outsole 200.

Outsole 200, and traction members 202A and 202B may comprise any suitable material or combination of materials, such as TPU, TPE, blown rubber, high abrasion rubber, etc. In some examples, the outsole and the traction members comprise the same material(s). In some examples, the outsole and the traction members comprise materials that have different hardness, malleability, density, color, resilience, elasticity, and/or translucency.

In this example, outsole 200 is coupled to a midsole 224 and midsole 224 is coupled to an upper 226 to form article of footwear 201. Outsole 200 is coupled to midsole 224 by adhesive, co-molding, and/or any other suitable process(es). Midsole 224 is coupled to upper 226 by any suitable process(es) known in the art.

Figure 4:
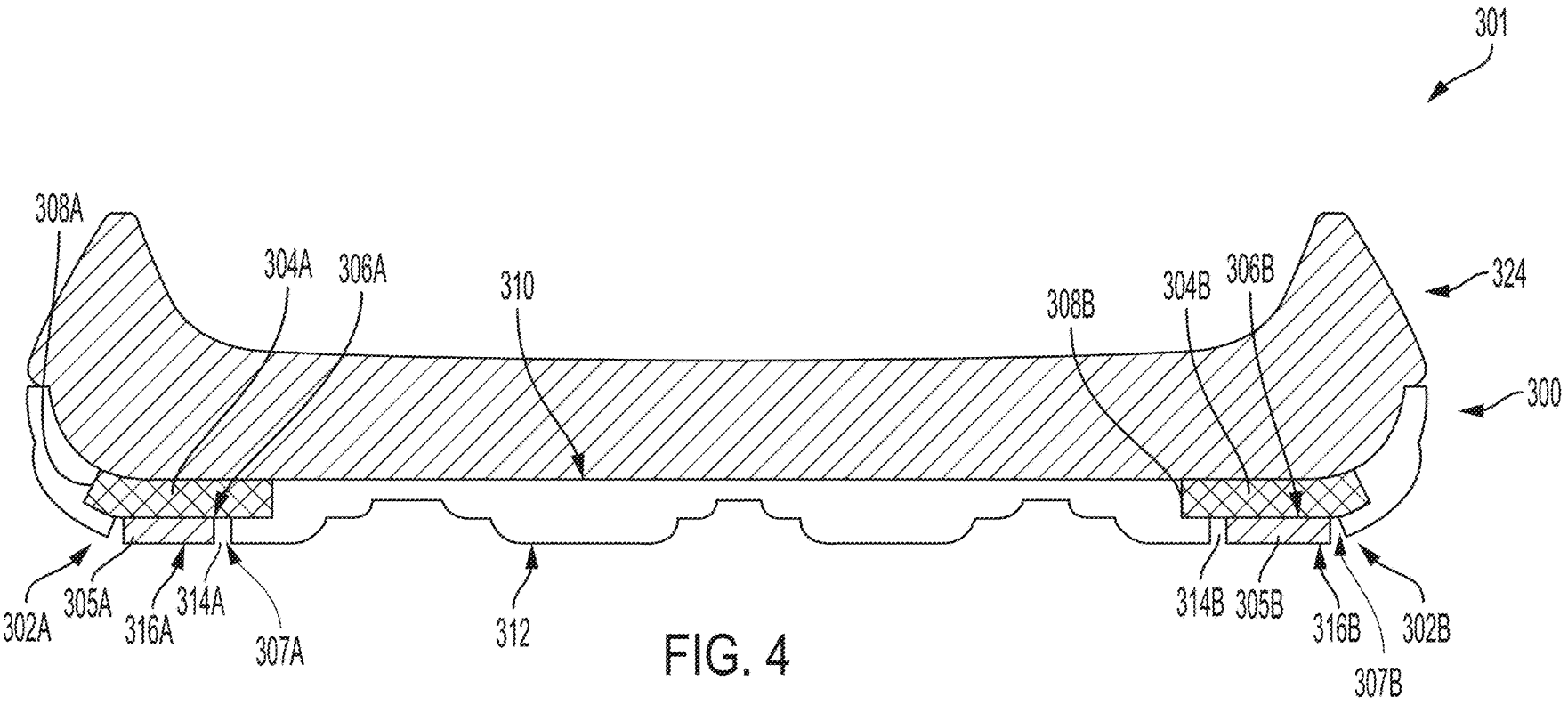
FIG. 4 is a sectional view of another illustrative sole for an article of footwear, corresponding to line 4-4 of FIG. 1.

FIG. 4 is a schematic sectional diagram of another outsole 300 incorporated in an article of footwear 301. Traction member 302A is disposed in a medial region of the outsole and traction member 302B is disposed in a lateral region of the outsole. Traction members 302A and 302B each comprise a protrusion (305A and 305B) and have a flange (304A and 304B) extending from an upper end (306A and 306B) of the protrusion. Traction members 302A and 302B are disposed in respective openings (307A and 307B) in outsole 300. Openings 307A and 307B each comprise a recess (308A and 308B) in a top face 310 of outsole 300. Flanges 304A and 304B are seated in recesses 308A and 308B.

Flanges 304A and 304B conform to the shape of recesses 308A and 308B. Flanges 304A and 304B are secured to recesses 308A and 308B. Recesses 308A and 308B are each coupled to a respective hole (314A and 314B) extending through the outsole to a ground-contacting face 312 of outsole 300. Protrusions 305A and 305B extend into holes 314A and 314B. Protrusions 305A and 305B each have a bottom surface (316A and 316B) terminating at ground-contacting face 312 of the outsole.

Outsole 300 is coupled to a midsole 324 by adhesive, by co-molding, and/or any other suitable device or process(es). In this and other examples, midsole 324 may be in direct contact with the top (e.g., the flange) of the traction member(s), such that the flange of the traction member is trapped or otherwise sandwiched between the outsole and the midsole.

Additional aspects and features of manufacturing methods for footwear outsoles having traction inserts are presented below, without limitation, as a series of paragraphs.

A0. An article of footwear comprising:

an outsole having an opening extending from a top face of the outsole to a ground-contacting face of the outsole; and a traction member disposed within the opening in the outsole, the traction member comprising a protruding portion and flange portion extending from an upper end of the protruding portion and secured to the top face of the outsole.

A1. The article of footwear of A0, wherein the opening includes a recess in the top face of the outsole in communication with a hole in the ground-contacting face, wherein the recess has a dimension larger than the hole.

A2. The article of footwear of A1, wherein a shape of the flange of the traction member conforms to a shape of the recess.

A3. The article of footwear of A1, wherein the protruding portion extends beyond the ground-contacting face of the outsole.

A4. The article of footwear of A1, wherein a bottom end of the protruding portion is flush with the ground-contacting face of the outsole.

A5. The article of footwear of A1, wherein the protruding portion extends only part way into the hole, such that a bottom end of the protruding portion is set back a selected distance from the ground-contacting face of the outsole.

A6. The article of footwear of any one of paragraphs A0 through A5, wherein the traction member comprises a first material and the outsole comprises a second material.

A7. The article of footwear of A6, wherein the first material has a hardness greater than the second material.

A8. The article of footwear of A6, wherein the first material has a hardness lower than the second material.

A9. The article of footwear of any one of paragraphs A0 through A8, wherein the traction member and the outsole comprise a same material.

A10. The article of footwear of any one of paragraphs A0 through A9, wherein the protruding portion comprises a bottom surface having a tread pattern.

A11. The article of footwear of paragraph A10, wherein the tread pattern is different than a tread pattern of a second traction member.

A12. The article of footwear of paragraph A10, wherein the tread pattern is different in different areas of the bottom surface.

A13. The article of footwear of paragraph A12, wherein the tread pattern forms an alternating pattern on the bottom surface.

A14. The article of footwear of paragraph A12, wherein the tread pattern changes progressively across the bottom surface.

A15. The article of footwear of any one of paragraphs A0 through A14, wherein the traction member comprises an elastomer.

A16. The article of footwear of any one of paragraphs A0 through A15, wherein the traction member comprises rubber.

A17. The article of footwear of any one of paragraphs A0 through A16, wherein the outsole comprises a rubber.

A18. The article of footwear of any one of paragraphs A0 through A17, wherein the outsole comprises a translucent rubber.

A19. The article of footwear of any one of paragraphs A0 through A18, further comprising a layer of material disposed on top of the outsole such that the flange of the traction member is sandwiched between the layer of material and the top face of the outsole.

A20. The article of footwear of A19, wherein the layer of material and the outsole each comprise rubber.

A21. The article of footwear of any one of paragraphs A0 through A20, wherein the flange of the traction member is generally orthogonal to the protruding portion.

A22. The article of footwear of any one of paragraphs A0 through A21, wherein the flange is secured to the top face of the outsole by an adhesive.

B. Illustrative Method

Figure 5:
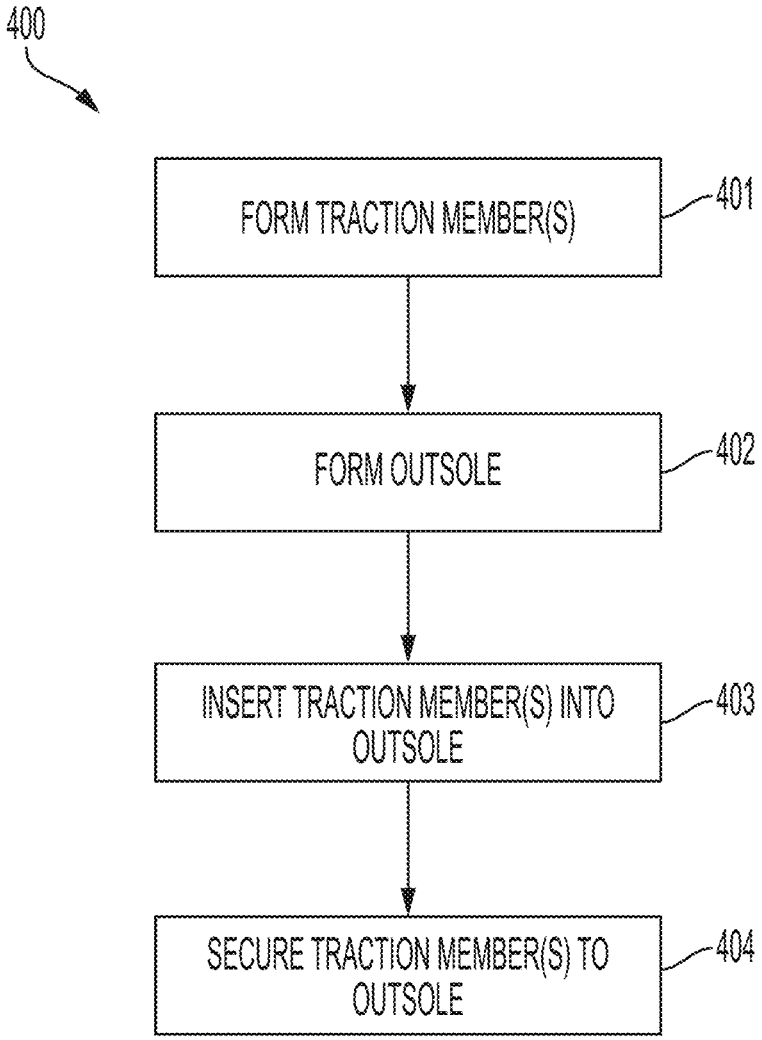
FIG. 5 is a flow chart depicting steps of an illustrative method of manufacturing an outsole in accordance with aspects of the present disclosure.

This section describes steps of an illustrative method of manufacturing a sole for footwear having traction members incorporated into an outsole; see FIG. 5. Aspects of the soles and articles of footwear described above may be utilized in the method steps described below. Where appropriate, reference may be made to components and systems that may be used in carrying out each step. These references are for illustration, and are not intended to limit the possible ways of carrying out any particular step of the method.

FIG. 5 is a flowchart illustrating steps performed in an illustrative method 400, and may not recite the complete process or all steps of the method. Although various steps of method 400 are described below and depicted in FIG. 5, the steps need not necessarily all be performed, and in some cases may be performed simultaneously or in a different order than the order shown.

Step 401 of method 400 includes forming one or more traction member(s) each comprising a flange and a protrusion, e.g., as described above with respect to traction members 102A-102D. The traction member(s) may be formed by compression molding, injection molding, dual injection molding, additive manufacturing (e.g., 3D printing), and/or any other suitable process(es). The traction member(s) may comprise TPU, TPE, blown rubber, high abrasion rubber, elastomers, and/or any other suitable material(s).

The flange and the protrusion of each of the traction members may have any one of a variety of different shapes, sizes, and/or planforms. In some examples, the planform of the flange is different than the planform of the protrusion. In some examples, the flange and the protrusion have an identical planform. In some examples, the flange and the protrusion have the same horizontal, and/or vertical dimensions. In some examples, the protrusion has a width and/or thickness greater than the flange, or vice versa. The protrusion and flange of a given traction member may have a different shape, size and/or planform than the protrusion and flange of another traction member.

In some examples, a bottom surface of each protrusion is configured to provide traction. For example, the bottom surface of a protrusion may have a tread pattern comprising ridges, sipes, channels, texturing, etc. In some examples, the tread pattern is different than a tread pattern of a second traction member. In some examples, the tread pattern is different in different areas of the bottom surface. For example, the tread pattern may form an alternating pattern on the bottom surface and/or the tread pattern may change progressively across the bottom surface.

Step 402 of method 400 includes forming an outsole having one or more openings therethrough. Each of the openings is configured to receive one of the traction member(s). The openings may be disposed in any suitable region or regions of the outsole. In some examples, the openings each include a recess in a top face of the outsole coupled to a hole extending to a ground-contacting face of the outsole. The outsole is formed by compression molding, injection molding, dual injection molding, additive manufacturing (e.g., 3D printing), and/or any other suitable process(es). The outsole comprises TPU, TPE, blown rubber, high abrasion rubber, and/or any other suitable material(s). In some examples the outsole comprises a translucent material. In some examples, the outsole comprises the same material as the traction member(s). In some examples, the outsole comprises a material having a different color, level of translucency, density, malleability, and/or hardness than the material comprising the traction member(s).

Step 403 of method 400 includes inserting each of the traction member(s) into the outsole. Each traction member is inserted into a respective opening in the outsole. In some examples, the traction member is inserted such that the flange sits in a respective recess in the top face of the outsole. In some examples, the flange conforms to the shape, and/or curvature of the recess. In some examples, the recess is absent from the opening and the traction member is inserted such that the flange sits on the top face of the outsole. In some examples, the protrusion of the traction member extends into the hole such that a bottom surface of the protrusion is coplanar with the ground-contacting face of the outsole. In some examples, the protrusion extends into the hole and beyond the ground-contacting face of the outsole.

Step 404 of method 400 includes securing, and/or fastening each traction member to the outsole. The flange is secured to the outsole for security and stability. In some examples, the flange of each traction member is secured to the top face of the outsole. In some examples, the flange of each traction member is secured to the respective recess in the top face of the outsole in which the flange is seated. The flange of each traction member is secured to the top face of the outsole, and/or the recess in the top face of the outsole by using adhesive, compression molding the traction member and the outsole in a same mold, compression molding using heat, and/or any other suitable process(es). The flange of each traction member is secured to the outsole such that the traction member is prevented from moving independently of the outsole. In some examples, securing each traction member in step 404 includes sandwiching the flange of the traction member between the outsole (e.g., the recess of the outsole) and a top layer of material. For example, a thin layer (e.g., of the same material as the outsole) may be fastened and/or molded atop the outsole and insert(s).

In some examples, steps 401 through 404 are performed simultaneously, such that the traction members are formed securely in the openings of the outsole.

Additional aspects and features of manufacturing methods for footwear outsoles having traction inserts are presented below, without limitation, as a series of paragraphs.

B0. A method of manufacturing an article of footwear, the method comprising:

forming an outsole having an opening extending from a top face of the outsole to a ground-contacting face of the outsole;

forming a traction member having a flange portion extending from an upper end of a protrusion configured to be received by the opening of the outsole; and inserting the protrusion of the traction member into the opening of the outsole and fastening the flange to the top face of the outsole.

B1. The method of B0, wherein forming the outsole comprises compression molding and/or wherein forming the traction member comprises compression molding.

B2. The method of B0 or B1, wherein forming the outsole comprises injection molding and/or wherein forming the traction member comprises injection molding.

B3. The method of any one of paragraphs B0 through B2, wherein forming the outsole comprises additive manufacturing and/or wherein forming the traction member comprises additive manufacturing.

B4. The method of any one of paragraphs B0 through B3, wherein the opening includes a recess in the top face of the outsole in communication with a hole in the ground-contacting face, wherein the recess has a dimension larger than the hole.

B5. The method of B4, wherein the recess has a different planform than the hole.

B6. The method of B4, wherein a shape of the flange of the traction portion conforms to a shape of the recess.

B7. The method of B6, wherein the flange is flush with the top face of the outsole when the traction member is inserted.

B8. The method of any one of paragraphs B0 through B7, wherein the protrusion extends beyond the ground-contacting face of the outsole.

B9. The method of any one of paragraphs B0 through B8, wherein the protrusion has a tread pattern.

B10. The method of paragraph B9, wherein the tread pattern is different than a tread pattern of a second traction member.

B11. The method of paragraph B10, wherein the tread pattern is different in different areas of the bottom surface.

B12. The method of paragraph B11, wherein the tread pattern forms an alternating pattern on the bottom surface.

B13. The method of paragraph B11, wherein the tread pattern changes progressively across the bottom surface.

B14. The method of B9, wherein the tread pattern comprises first sipes oriented in a first direction, and the outsole comprises second sipes oriented in a second direction adjacent the protrusion.

B15. The method of B9, wherein the tread pattern is different than a second tread pattern of the outsole.

B16. The method of any one of paragraphs B0 through B15, wherein forming the outsole comprises forming the outsole in a first mold, and forming the traction member comprises forming the traction member in a second mold.

B17. The method of any one of paragraphs B0 through B16, wherein the traction member comprises a first material and the outsole comprises a second material.

B18. The method of B17, wherein the second material comprises rubber.

B19. The method of B17, wherein the second material comprises a translucent rubber.

B20. The method of B17, wherein the first material has a hardness greater than the second material.

B21. The method of B17, wherein the first material comprises an elastomer.

B22. The method of any one of paragraphs B0 through B21, wherein the flange of the traction member is generally orthogonal to the protrusion.

B23. The method of any one of paragraphs B0 through B22, wherein fastening the flange to the top face of the outsole includes using an adhesive.

B24. The method of any one of paragraphs B0 through B23, wherein fastening the flange to the top face of the outsole includes compression molding the outsole and the traction member in a same mold.

B25. The method of any one of paragraphs B0 through B24, further comprising adding a layer of material on top of the outsole after the traction member is inserted, such that the flange of the traction member is sandwiched between the layer of material and the top face of the outsole.

B26. The method of B25, wherein the layer of material and the outsole both comprise rubber.

B27. The method of B25, wherein fastening the flange to the top face of the outsole comprises compression molding the layer of material, the traction member, and the outsole.

B28. The method of B28, wherein the compression molding is performed using heat.

C0. A method of manufacturing an article of footwear, the method comprising:

forming a traction member comprising a flange portion and a protrusion;

inserting the protrusion of the traction member into an opening in an outsole extending from a top face of the outsole to a ground-contacting face of the outsole; and securing the flange to the top face of the outsole.

C1. The method of C0, wherein forming the outsole comprises compression molding and/or wherein forming the traction member comprises compression molding.

C2. The method of C0 or C1, wherein forming the outsole comprises injection molding and/or wherein forming the traction member comprises injection molding.

C3. The method of any one of paragraphs C0 through C2, wherein forming the outsole comprises additive manufacturing and/or wherein forming the traction member comprises additive manufacturing.

C4. The method of any one of paragraphs C0 through C3, wherein the opening includes a recess in the top face of the outsole in communication with a hole in the ground-contacting face, wherein the recess has a dimension larger than the hole.

C5. The method of C4, wherein the recess has a different planform than the hole.

C6. The method of C4, wherein a shape of the flange of the traction portion conforms to a shape of the recess.

C7. The method of C6, wherein the flange is flush with the top face of the outsole when the traction member is inserted.

C8. The method of any one of paragraphs C0 through C7, wherein the protrusion extends beyond the ground-contacting face of the outsole.

C9. The method of any one of paragraphs C0 through C8, wherein the protrusion has a tread pattern.

C10. The method of C9, wherein the tread pattern comprises first sipes oriented in a first direction, and the outsole comprises second sipes oriented in a second direction adjacent the protrusion.

C11. The method of C9, wherein the tread pattern is different than a second tread pattern of the outsole.

C12. The method of C9, wherein the tread pattern is different than a tread pattern of a second traction member.

C13. The method of C9, wherein the tread pattern is different in different areas of the bottom surface.

C14. The method of C9, wherein the tread pattern forms an alternating pattern on the bottom surface.

C15. The method of C9, wherein the tread pattern changes progressively across the bottom surface.

C16. The method of any one of paragraphs C0 through C15, wherein forming the outsole comprises forming the outsole in a first mold, and forming the traction member comprises forming the traction member in a second mold.

C17. The method of any one of paragraphs C0 through C16, wherein the traction member comprises a first material and the outsole comprises a second material.

C18. The method of C17, wherein the second material comprises rubber.

C19. The method of C18, wherein the second material comprises a translucent rubber.

C20. The method of C17, wherein the first material has a hardness greater than the second material.

C21. The method of C17, wherein the first material comprises an elastomer.

C22. The method of any one of paragraphs C0 through C21, wherein the flange of the traction member is generally orthogonal to the protrusion.

C23. The method of any one of paragraphs C0 through C22, wherein the flange extends from an upper end of the protrusion.

C24. The method of any one of paragraphs C0 through C23, wherein fastening the flange to the top face of the outsole includes using an adhesive.

C25. The method of any one of paragraphs C0 through C24, wherein fastening the flange to the top face of the outsole includes compression molding the outsole and the traction member in a same mold.

C26. The method of any one of paragraphs C0 through C25, further comprising adding a layer of material on top of the outsole after the traction member is inserted, such that the flange of the traction member is sandwiched between the layer of material and the top face of the outsole.

C27. The method of C26, wherein the layer of material and the outsole both comprise rubber.

C28. The method of C26, wherein fastening the flange to the top face of the outsole comprises compression molding the layer of material, the traction member, and the outsole.

C29. The method of C28, wherein the compression molding is performed using heat.

Advantages, Features, and Benefits

The different embodiments and examples of outsoles for footwear described herein provide several advantages over known solutions. For example, illustrative embodiments and examples described herein facilitate positioning of traction member(s) in any suitable region of the outsole, including to provide additional traction, stability, and/or visual appeal to the outsole. Added traction and stability provided by the traction member(s) may improve the performance and comfort of an article of footwear.

Additionally, and among other benefits, illustrative embodiments and example methods described herein allow for the use of a variety of different materials and/or processes to form the outsole and the traction members. By varying the materials and/or processes utilized to form the outsole and the traction members, it is possible to manufacture many different outsoles for footwear having different functionalities and appearances.

Additionally, and among other benefits, illustrative embodiments and examples described herein allow for transitioning between the manufacturing of outsoles having different properties with little or no change of equipment.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. An article of footwear comprising:

an outsole having a plurality of spaced apart openings, wherein each of the openings extends from a top face of the outsole to a ground-contacting face of the outsole; and a respective independent traction member disposed within each opening in the outsole, each traction member comprising a protruding portion and a flange portion extending from an upper end of the protruding portion and secured to the top face of the outsole;

a first tread pattern formed on a bottom surface of the protruding portion of each respective traction member, the first tread pattern having a first overall orientation;

a second tread pattern formed on the ground-contacting face of the outsole adjacent the protruding portion of each traction member, wherein the second tread pattern has a second overall orientation different than the first overall orientation;

a layer of material permanently affixed to at least part of the top face of the outsole, such that the respective flange of each traction member is sandwiched between the layer of material and the top face of the outsole; and a midsole disposed immediately above and in direct contact with the layer of material.

2. The article of footwear of claim 1, wherein each of the openings includes a respective recess in the top face of the outsole in communication with a respective hole in the ground-contacting face, wherein the recess has a dimension larger than the hole.

3. The article of footwear of claim 2, wherein a shape of the flange of each independent traction member conforms to a shape of the respective recess.

4. The article of footwear of claim 1, wherein the traction member comprises a first material and the outsole comprises a second material.

5. The article of footwear of claim 4, wherein the first material and the second material each have a different hardness.

6. The article of footwear of claim 1, wherein the traction member comprises an elastomer.

7. The article of footwear of claim 1, wherein the outsole comprises a translucent rubber.

8. The article of footwear of claim 1, wherein the flange is secured to the top face of the outsole by an adhesive.

9. An article of footwear comprising:

an outsole having a plurality of spaced apart openings each extending from a top face of the outsole to a ground-contacting face of the outsole;

a plurality of isolated traction members, each of the traction members disposed within a respective one of the openings in the outsole, each traction member comprising a protruding portion and a flange portion extending from an upper end of the protruding portion and secured to the top face of the outsole;

a layer comprising a same material as the outsole, wherein the layer is disposed over an entirety of the top face of the outsole, such that the respective flange of each traction member is sandwiched between the layer and the top face of the outsole, and the layer is permanently affixed to at least part of the top face of the outsole and to the respective flange of each traction member; and a midsole disposed immediately above and in direct contact with the layer.

10. The article of footwear of claim 9, wherein each of the openings includes a respective recess in the top face of the outsole in communication with a respective hole in the ground-contacting face, wherein the recess has a dimension larger than the hole.

11. The article of footwear of claim 10, wherein a shape of the flange of each isolated traction member conforms to a shape of the respective recess.

12. The article of footwear of claim 9, wherein the traction member comprises a first material and the outsole comprises a second material.

13. The article of footwear of claim 12, wherein the first material and the second material each have a different hardness.

14. The article of footwear of claim 9, further comprising a first tread pattern formed on a bottom surface of the protruding portion of the traction member, the first tread pattern having a first overall orientation; and a second tread pattern formed on the ground-contacting face of the outsole adjacent the protruding portion of the traction member, wherein the second tread pattern has a second overall orientation different than the first overall orientation.

15. The article of footwear of claim 9, wherein the traction member comprises an elastomer.

16. The article of footwear of claim 9, wherein the outsole comprises a translucent rubber.

17. The article of footwear of claim 9, wherein the flange is secured to the top face of the outsole by an adhesive.

18. The article of footwear of claim 9, wherein the midsole is separated from each of the traction members by the layer, such that the midsole does not contact the traction members.

* * * * *